US008866723B2

(12) United States Patent
Jang et al.

(10) Patent No.: US 8,866,723 B2
(45) Date of Patent: Oct. 21, 2014

(54) DISPLAY DEVICE

(75) Inventors: Kwangho Jang, Seoul (KR); Jinwon Chung, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 660 days.

(21) Appl. No.: 12/843,742

(22) Filed: Jul. 26, 2010

(65) Prior Publication Data

US 2011/0148849 A1 Jun. 23, 2011

(30) Foreign Application Priority Data

Dec. 22, 2009 (KR) ..... 10-2009-0129155

(51) Int. Cl.

| | |
|---|---|
| ***G09G 3/36*** | (2006.01) |
| ***G09G 3/20*** | (2006.01) |
| *G09G 3/32* | (2006.01) |

(52) U.S. Cl.

CPC ..... *G09G 3/20* (2013.01); *G09G 2300/0842* (2013.01); *G09G 3/3648* (2013.01); *G09G 2310/08* (2013.01); *G09G 3/3225* (2013.01); *G09G 2370/08* (2013.01); *G09G 3/3233* (2013.01)

USPC ..... 345/99

(58) Field of Classification Search

USPC ..... 345/99

See application file for complete search history.

(56) References Cited

U.S. PATENT DOCUMENTS

| | | | | |
|---|---|---|---|---|
| 4,170,141 | A * | 10/1979 | Woo | 73/579 |
| 5,731,741 | A * | 3/1998 | Yamamoto et al. | 331/11 |
| 5,926,174 | A * | 7/1999 | Shibamiya et al. | 345/213 |
| 2004/0145556 | A1 * | 7/2004 | Nakanishi | 345/99 |

FOREIGN PATENT DOCUMENTS

| | | | |
|---|---|---|---|
| CN | 101188097 | A | 5/2008 |
| CN | 101315486 | A | 12/2008 |
| KR | 10-2008-0064245 | A | 7/2008 |

* cited by examiner

*Primary Examiner* — Kevin M Nguyen
*Assistant Examiner* — Cory Almeida
(74) *Attorney, Agent, or Firm* — Birch, Stewart, Kolasch & Birch, LLP

(57) ABSTRACT

A display device according to an embodiment comprises: a display panel; a data driver that supplies a data signal to the display panel; a gate driver that supplies a gate signal to the display panel; and a timing driver that controls the data driver and the gate driver and comprises a voltage controlled oscillator of which frequency is varied according to a control signal generated in the timing driver.

7 Claims, 6 Drawing Sheets

DISPLAY DEVICE

This nonprovisional application claims priority under 35 U.S.C. §119(a) on Patent Application No. 10-2009-0129155 filed in Republic of Korea on Dec. 22, 2009, the entire contents of which are hereby incorporated by reference.

BACKGROUND

1. Field

This document relates to a display device.

2. Related Art

As the information technology is advancing, the markets of display devices, connection mediums between users and information, are expanding. Accordingly, the use of flat panel displays (FPDs) such as a liquid crystal display (LCD), an organic light emitting display (OLED), a plasma display panel (PDP), and the like is increasing. Among them, the LCD that implements high resolution and is available to have a large size as well as a small size is commonly used.

Some of the foregoing display devices, for example, the LCD or the OLED device, are driven by a timing driver, a gate driver, a data driver, and the like, that drive a plurality of subpixels disposed in a matrix form.

In this case, however, it is not easy for the timing driver driving the display device to adjust the frequency of a voltage controlled oscillator (VCO), or if an actually output value is different from a designed value, it is not easy to change it, which, thus, needs to be improved.

SUMMARY

In an aspect of the invention, a display device comprises: a display panel; a data driver that supplies a data signal to the display panel; a gate driver that supplies a gate signal to the display panel; and a timing driver that controls the data driver and the gate driver and comprises a voltage controlled oscillator of which frequency is varied according to a control signal generated in the timing driver.

Embodiments of the invention are directed to a display device and its methods, which address the limitations and disadvantages associated with the related art.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Reference will now be made in detail embodiments of the invention examples of which are illustrated in the accompanying drawings.

A display device according to exemplary embodiments of the present invention will now be described in detail with reference to the accompanying drawings.

Figure 1:
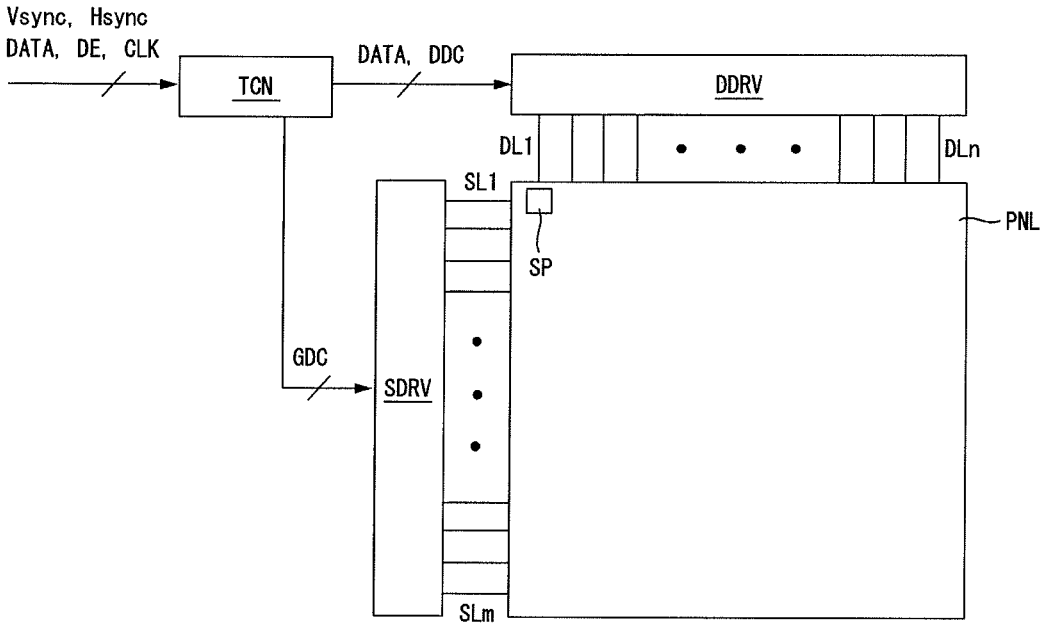
FIG. 1 is a schematic block diagram of a display device according to an exemplary embodiment of the present invention.

As shown in FIG. 1, a display device according to an exemplary embodiment of the present invention comprises a timing driver TCN, a display panel PNL, a gate driver SDRV, and a data driver DDRV. The display device can be any display device, e.g., a liquid crystal display device, etc.

The timing driver TCN receives a vertical synchronous signal Vsync, a horizontal synchronous signal Hsync, a data enable signal DE, a clock signal CLK, and data signals RGB from an external source. The timing controller TCN controls an operational timing of the data driver DDRV and the gate driver SDRV by using the timing signals such as the vertical synchronous signal Vsync, the horizontal synchronous signal Hsync, the data enable signal DE, and the clock signal CLK. In this case, because the timing driver TCN can determine a frame period by counting the data enable signal DE during a one horizontal period, the vertical synchronous signal Vsync and the horizontal synchronous signal Hsync may be omitted. Control signals generated by the timing driver TCN may comprise a gate timing control signal GDC for controlling an operational timing of the gate driver SDRV and a data timing control signal DDC for controlling an operational timing of the data driver DDRV. The gate timing control signal GDC comprises a gate start pulse GSP, a gate shift clock GSC, a gate output enable signal GOE, and the like. The gate start pulse GSP is supplied to a gate drive integrated circuit (IC) from which a first gate signal is generated. The gate shift clock GSC, which is a clock signal commonly inputted to gate drive ICs, is used to shift the gate start pulse GSP. The gate output enable GOE signal controls outputs of the gate drive ICs. The data timing control signal DDC comprises a source start pulse SSP, a source sampling clock SSC, a source output enable signal SOE, and the like. The source start pulse SSP controls a data sampling start point of the data driver DDRV. The source sampling clock SSC is a clock signal for controlling a sampling operation of data within the data driver DDRV based on a rising or falling edge. Meanwhile, the source start pulse SSP supplied to the data driver DDRV may be omitted according to a data transmission method.

Figure 2:
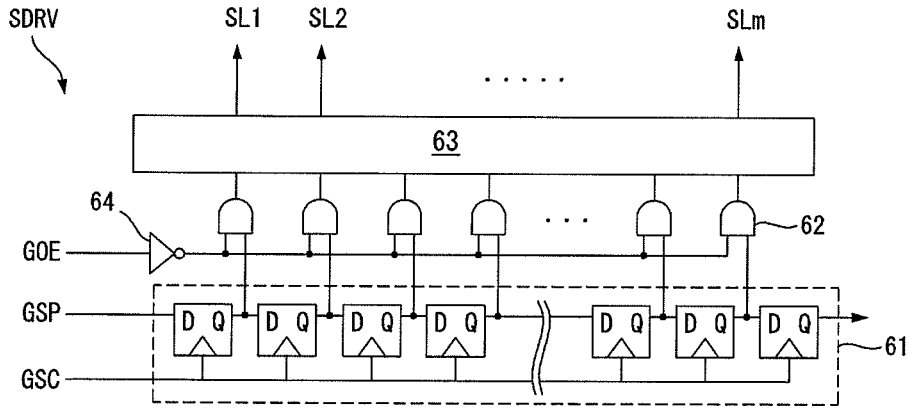
FIG. 2 illustrates the configuration of a subpixel circuit of a liquid crystal panel according to an embodiment of the present invention.

The gate driver SDRV sequentially generates gate signals while shifting the levels of the signals with a swing width of a gate driving voltage with which the transistors of the subpixels SP included in the display panel PNL can operate in response to the gate timing control signal GDC provided from the timing driver TCN. The gate driver SDRV supplies the generated gate signals through gate lines SL1~SLm to the subpixels SP included in the display panel PNL. As shown in FIG. 2, the gate driver SDRV comprises a shift register 61, a level shifter 63, a plurality of AND gates connected between the shift register 61 and the level shifter 63, an inverter 64 for inverting the gate output enable signal GOE, and the like, respectively. The shift register 61 sequentially shifts gate pulses GSP according to the gate shift clock GSC by using a plurality of dependently connected D-flip-flops. The AND gates 62 AND an output signal of the shift register 61 and an inverse signal of the gate output enable signal GOE to generate an output. The inverter 64 inverts the gate output enable signal GOE and supplies the same to the AND gates 62. The level shifter 63 shifts an output voltage swing width of the AND gates 62 to a gate voltage swing width with which the transistors included in the display panel PNL can operate. The gate signal outputted from the level shifter 63 is sequentially supplied to the gate lines SL1—SLm.

Figure 3:
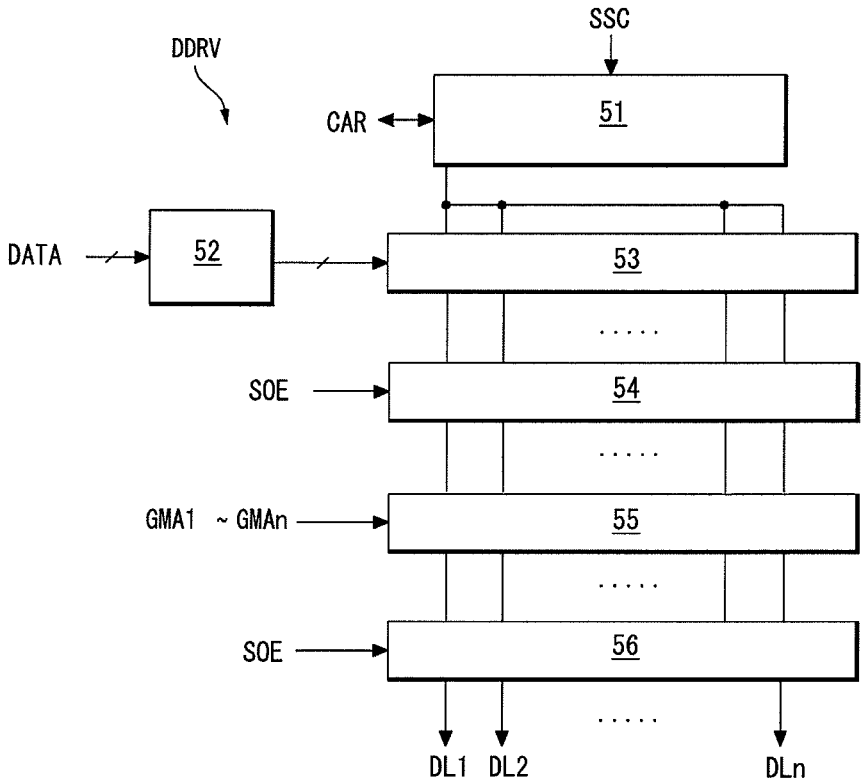
FIG. 3 illustrates the configuration of a subpixel circuit of an organic light emitting display panel according to an embodiment of the present invention.

In response to the data timing control signal DDC provided from the timing controller TCN, the data driver DDRV samples the data signals DATA supplied from the timing driver TCN and latches the same to convert them into data of a parallel data system. In converting the signal into the data of a parallel data system, the data driver DDRV converts the data signal DATA into a gamma reference voltage. The data driver DDRV supplies the converted data signal to the subpixels SP included in the display panel PNL through the data lines DL1~DLn. As shown in FIG. 3, the data driver DDRV comprises a shift register 51, a data register 52, a first latch 53, a second latch 54, a converter 55, an output circuit 56, and the like, respectively. The shift register 51 shifts the source sampling clock SSC provided from the timing driver TCN. The shift register 51 delivers a carry signal CAR to a shift register of a source drive IC of a neighboring next stage. The data register 52 temporarily stores the data signals DATA provided from the timing driver TCN and supplies them to the first latch 53. The first latch 53 samples the digital data signals DATA inputted in series according to clocks sequentially supplied from the shift register 51, latches the same, and simultaneously outputs the latched data. The second latch 54 latches the data provided from the first latch 53, and simultaneously outputs the latched data in synchronization with second latches of other source drives ICs in response to the source output enable signal SOE. The converter 55 converts the data signals DATA inputted from the second latch 54 into gamma reference voltages GMA1~GMAn. The data signals DATA outputted from the output circuit 56 are supplied to the data lines DL1~DLn in response to the source output enable signal SOE.

Figure 4:
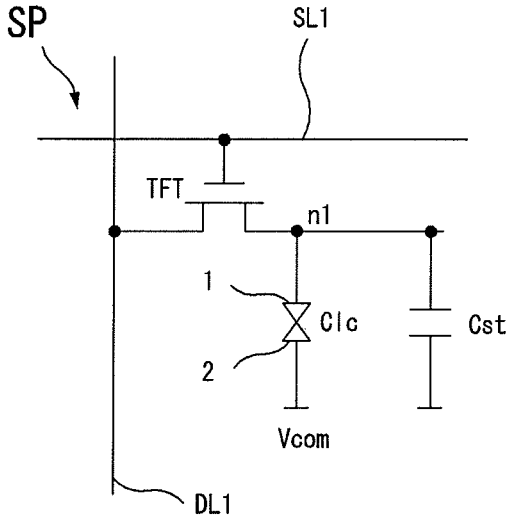
FIG. 4 is a schematic block diagram of a gate driver according to an embodiment of the present invention.

The display panel PNL comprises subpixels SP disposed in a matrix form. The display panel PNL may be configured as a liquid crystal panel or an organic light emitting display panel. When the display panel PNL is configured as a liquid crystal panel, the subpixel SP may have such a circuit configuration as shown in FIG. 4. In FIG. 4, a gate of a switching transistor TFT is connected to the gate line SL1 through which a gate signal is supplied, one end of the switching transistor TFT is connected to the data line DL1 through which a data signal is supplied, and the other end of the switching transistor TFT is connected to a first node n1. One end of a pixel electrode 1 positioned at one side of a liquid crystal cell Clc is connected to the first node n1 connected to the other end of the switching transistor TFT, and a common electrode 2 positioned at the other side of the liquid crystal cell Clc is connected to a common voltage line Vcom. One end of a storage capacitor Cst is connected to the first node n1, and the other end of the storage capacitor Cst is connected to a common voltage line Vcom. The liquid crystal panel having such a subpixel SP structure can display an image according to a light transmission based on variations of the liquid crystal layer included in each subpixel according to the gate signal supplied through the gate line SL1 and the data signal supplied through the data line DL1.

Figure 5:
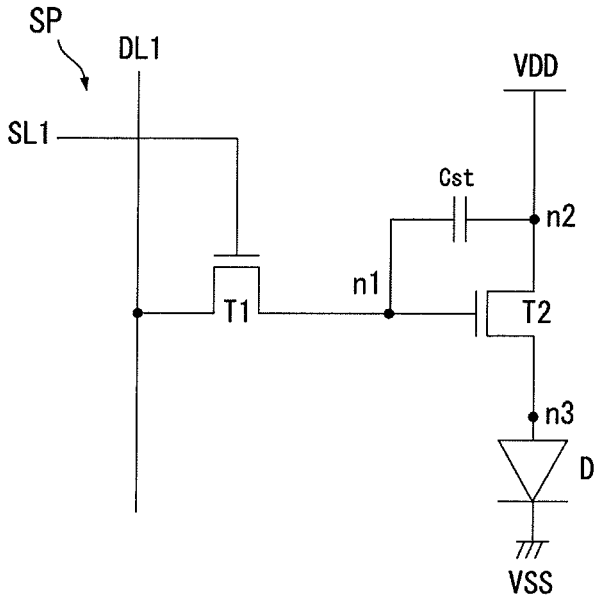
FIG. 5 is a schematic block diagram of a data driver according to an embodiment of the present invention.

Meanwhile, when the display panel PNL is configured as an organic light emitting display panel, the subpixel may have such a circuit configuration as shown in FIG. 5. A gate of a switching transistor T1 is connected to the gate line SL1 through which a gate signal is supplied, one end of the switching transistor T1 is connected to the data line DL1 through which a data signal is supplied, and the other end of the switching transistor T1 is connected to the first node n1. A gate of a driving transistor T2 is connected to the first node n1, one end of the driving transistor T2 is connected to a second node n2 connected to a first power line VDD through which high potential driving power VDD is supplied, and the other end of the driving transistor T2 is connected to a third node n3. One end of the storage capacitor Cst is connected to the first node, and the other end thereof is connected to the second node n2. An anode of an organic light emitting diode D is connected to the third node connected to the other end of the driving transistor T2, and a cathode thereof is connected to a second power line VSS through which low potential driving power Vss is supplied. The organic light emitting display panel having such a subpixel SP structure can display an image as a light emission layer included in each subpixel emit light according to the gate signal supplied through the gate line SL1 and the data signal supplied through the data line DL1.

The display device according to an exemplary embodiment of the present invention will now be described in more detail.

First Embodiment

Figure 6:
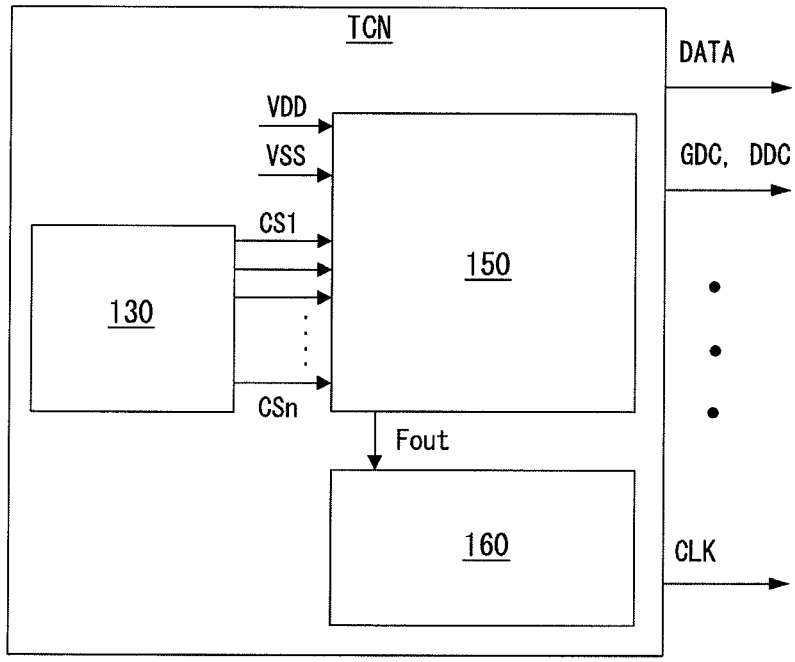
FIG. 6 is a schematic block diagram of a timing driver according to a first exemplary embodiment of the present invention.

FIG. 6 is a schematic block diagram of a timing driver according to a first exemplary embodiment of the present invention.

As shown in FIG. 6, the timing driver TCN comprises a voltage controlled oscillator (VCO) 150 that generates frequency by itself and a controller 160 that generates a driving signal by using the frequency supplied from the VCO 150. An output frequency Fout of the VCO 150 is varied according to N number of control signals CS1~CSn generated in the timing driver TCN. Thus, the output frequency FOUT of the VCO 150 is varied by power source voltages VDD and VSS and the N number of control signals CS1~CSn inputted to the VCO 150. In the present exemplary embodiment, the output voltage Fout of the VCO 150 is varied according to the combination of N number of control signals CS1~CSn outputted from a memory unit 130 (e.g., an internal memory such as an EEPROM or the like) included in the timing driver TCN. The N number of control signals CS1~CSn may be stored in the form of 0 and 1 bits in the memory unit 130.

Second Embodiment

Figure 7:
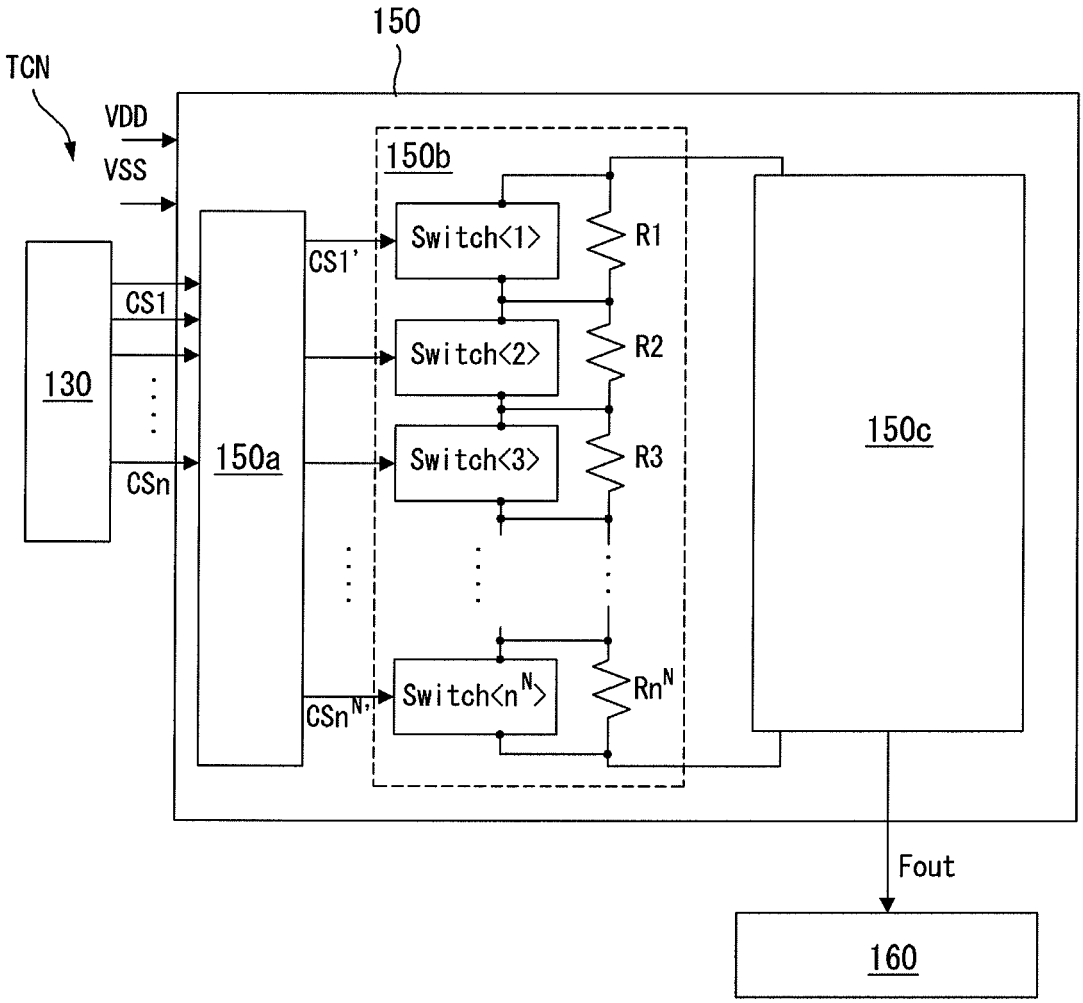
FIG. 7 is a schematic block diagram of a voltage controlled oscillator (VCO) according to a second exemplary embodiment of the present invention.

FIG. 7 is a schematic block diagram of a voltage controlled oscillator (VCO) according to a second exemplary embodiment of the present invention.

As shown in FIG. 7, the timing driver TCN comprises the memory unit 130, the VCO 150, and the controller 160.

The VCO 150 comprises frequency converters 150*a* and 150*b* that control a voltage controlled oscillation element 150*c* by using the N number of control signals CS1~CSn supplied from the memory unit 130. Resistance values of the frequency converters 150*a* and 150*b* are varied according to the combination of the N number of control signals CS1~CSn, and the output frequency Fout of the voltage controlled oscillation element 150*c* may be varied according to the varied resistance values.

The frequency converters 150*a* and 150*b* may comprise a decoder unit 150*a* and a combining unit 150*b*. The decoder unit 150*a* converts the N number of control signals CS1—CSn outputted from the memory unit 130 into $2^N$ number of control signals CS1'~CSn$^{N'}$. For example, when two signals are inputted, the decoder unit 150*a* outputs four signals, and when three signals are inputted, the decoder 150*a* outputs eight signals. The combining unit 150*b* combines the $2^N$ number of control signals CS1'~CSn$^{N'}$ outputted from the decoder unit 150*a* and supplies the same to the voltage controlled oscillation element 150*c*.

The combining unit 150*b* comprises $2^N$ number of switch units Switch<1>~Switch<n$^N$> that perform a switching operation, respectively, in response to the $2^N$ number of control signals CS1'~CSn$^{N'}$ outputted from the decoder unit 150*a* and resistor units R1~Rn$^N$ of which resistance values are varied according to the switching operations of the $2^N$ number of switch units Switch<1>~Switch<n$^N$>.

The resistor units R1~Rn$^N$ comprise the first resistor unit R1 to $2^N$th resistor unit Rn$^N$ formed in series, and the $2^N$ number of switch units Switch<1>~Switch<n$^N$> are connected in parallel to the first resistor unit R1 to $2^N$th resistor unit Rn$^N$. Among the resistor units R1~Rn$^N$, one end of the first resistor R1 and one end of the $2^N$th resistor Rn$^N$ are connected to the voltage controlled oscillation element 150*c*. Accordingly, the resistance values of the resistor units R1~Rn$^N$ are varied by the $2^N$ number of switch units Switch<1>~Switch<n$^N$> that perform a switching operation, respectively, in response to the $2^N$ number of control signals CS1'~CSn$^{N'}$, and the output frequency Fout of the voltage controlled oscillation element 150*c* is varied according to the varied resistance values.

Third Embodiment

Figure 8:
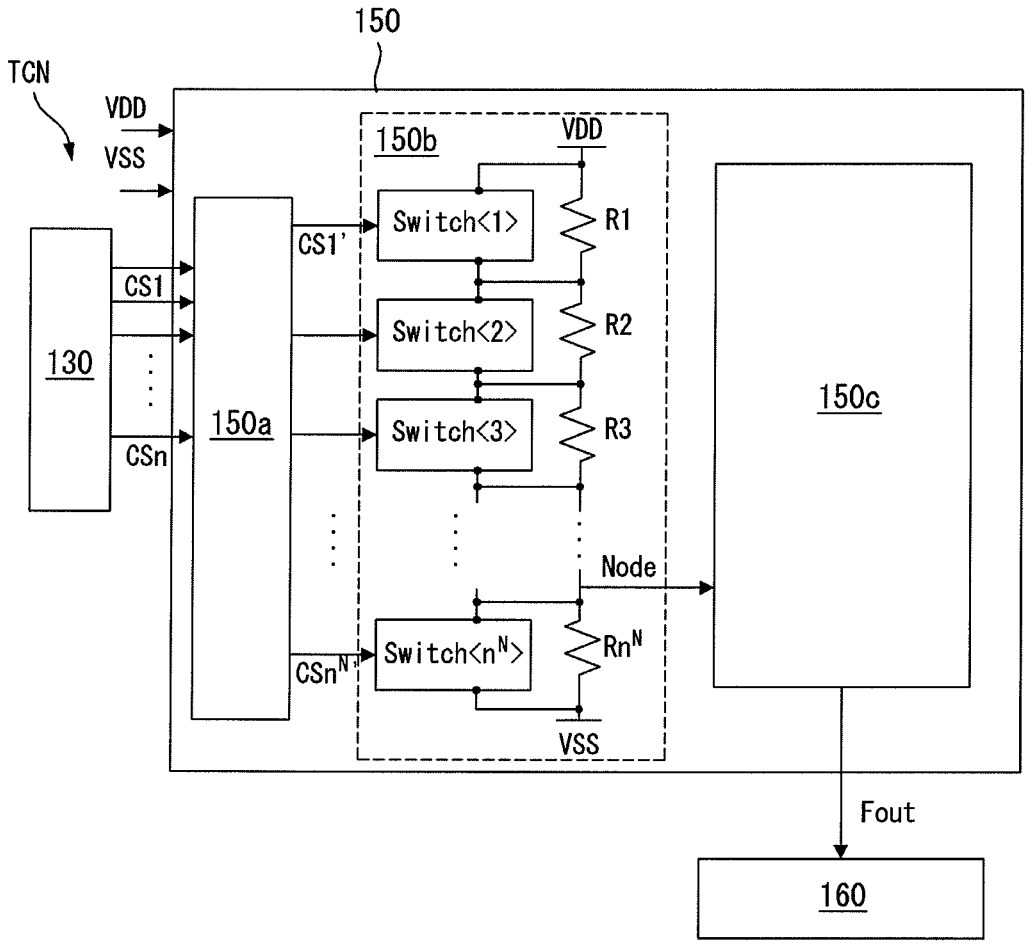
FIG. 8 is a schematic block diagram of a VCO according to a third exemplary embodiment of the present invention.

FIG. 8 is a schematic block diagram of a VCO according to a third exemplary embodiment of the present invention.

As shown in FIG. 8, the timing driver TCN comprises the memory unit 130, the VCO 150, and the controller 160.

The VCO 150 comprises frequency converters 150*a* and 150*b* that control a voltage controlled oscillation element 150*c* by using the N number of control signals CS1~CSn supplied from the memory unit 130. Resistance values of the frequency converters 150*a* and 150*b* are varied according to the combination of the N number of control signals CS1—CSn, and the output frequency Fout of the voltage controlled oscillation element 150*c* may be varied according to the varied resistance values.

The frequency converters 150*a* and 150*b* may comprise a decoder unit 150*a* and a combining unit 150*b*. The decoder unit 150*a* converts the N number of control signals CS1~CSn outputted from the memory unit 130 into $2^N$ number of control signals CS1'~CSn$^{N'}$. The combining unit 150*b* combines the $2^N$ number of control signals CS1'~CSn$^{N'}$ outputted from the decoder unit 150*a* and supplies the same to the voltage controlled oscillation element 150*c*.

The combining unit 150*b* comprises $2^N$ number of switch units Switch<1>~Switch<n$^N$> that perform a switching operation, respectively, in response to the $2^N$ number of control signals CS1'~CSn$^{N'}$ outputted from the decoder unit 150*a* and resistor units R1~Rn$^N$ of which resistance values are varied according to the switching operations of the $2^N$ number of switch units Switch<1>~Switch<n$^N$>.

The resistor units R1~Rn$^N$ comprise the first resistor unit R1 to $2^N$th resistor unit Rn$^N$ formed in series, and the $2^N$ number of switch units Switch<1>~Switch<n$^N$> are connected in parallel to the first resistor unit R1 to $2^N$th resistor unit Rn$^N$. Among the resistor units R1~Rn$^N$, one end of the first resistor R1 is connected to the first power line VDD, one end of the $2^N$th resistor Rn$^N$ is connected to the second power line VSS, and at least one of the nodes connecting the first resistor R1 to the $2^N$th resistor Rn$^N$ is connected to the voltage controlled oscillation element 150*c*. Accordingly, the resistance values of the $2^N$ number of resistor units R1~Rn$^N$ are varied by the $2^N$ number of switch units Switch<1>~Switch<n$^N$> that perform a switching operation, respectively, in response to the $2^N$ number of control signals CS1'~CSn$^{N'}$, and the output frequency Fout of the voltage controlled oscillation element 150*c* is varied according to the varied resistance values.

When the units included in the timing driver TCN are configured likewise as in the second and third exemplary embodiments, when 0 is inputted to the Kth control signal CSk', the Kth switch unit Switch<k> may transfer a signal (or current or voltage) outputted from the voltage controlled oscillation element 150*c* to the Kth resistor Rk. If 1 is inputted to the Kth control signal CSk', the Kth switch unit Switch<k> may transfer the signal (current or voltage) outputted from the voltage controlled oscillation element 150*c* to a node connected with the K+1th resistor Rk+1. However, these are examples, and response setting with respect to 0 and 1 may vary according to the characteristics of the $2^N$ number of switch units Switch<1>~Switch<n$^N$>.

Meanwhile, in the second and third exemplary embodiments of the present invention, the decoder unit 150*a* is employed to vary the frequency outputted from the voltage controlled oscillation element 150*c*, but the present invention is not limited thereto and the decoder unit 150*a* may be omitted. In this case, although the combining unit 150*b* is designed to go with the N number of control signals CS1~CSn supplied from the memory unit 130, it can vary a resistance value, so the output frequency Fout of the voltage controlled oscillation element 150*c* can be varied. Also, in the second and third exemplary embodiments, the frequency converters 150*a* and 150*b* are included in the VCO 150, but without being limited thereto, the frequency converters 150*a* and 150*b* may be configured at an outer side of the VCO 150. Also, in the second and third exemplary embodiments, the resistance values of the $2^N$ number of resistor units R1~Rn$^N$ included in the combining unit 150*b* are changed, but a capacitance value of a capacitor required when frequency is varied may be also changed.

The frequency varying operation of the VCO according to exemplary embodiments of the present invention will now be described.

Figure 9:
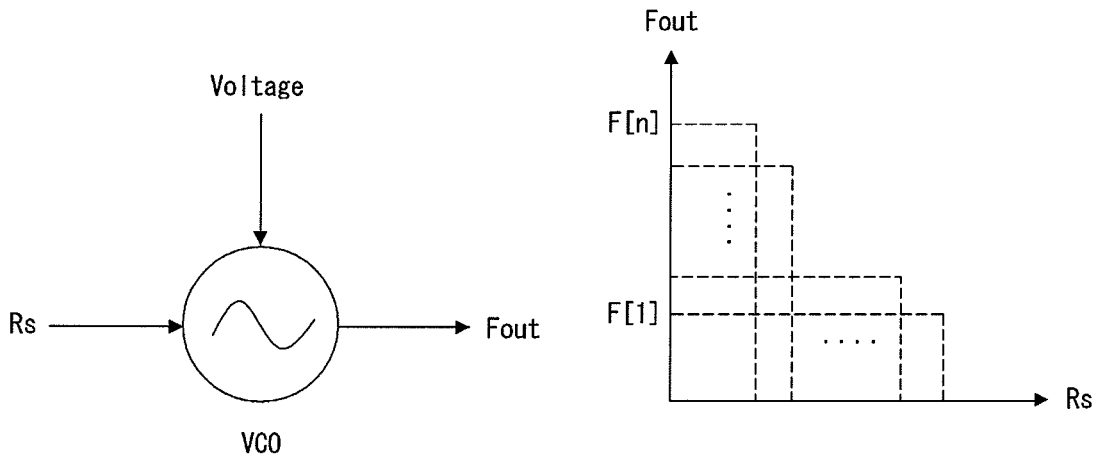
FIG. 9 is a view for explaining a frequency varying operation of the VCO according to an embodiment of the present invention.
Figure 10:
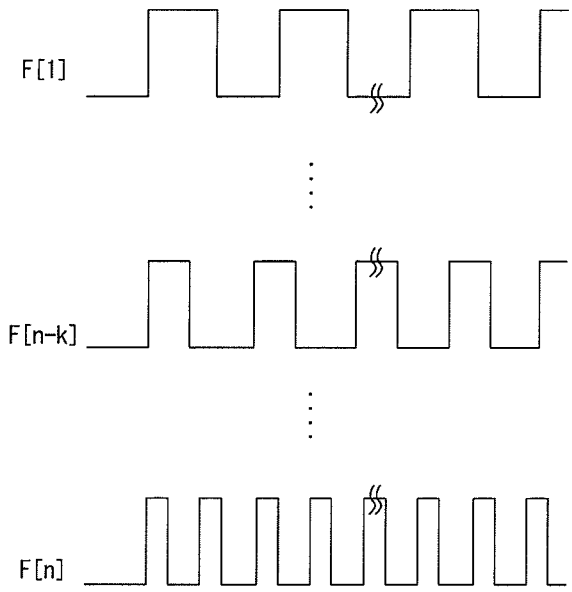
FIG. 10 illustrates output frequencies of the VCO according to an embodiment of the present invention.

FIG. 9 is a view for explaining a frequency varying operation of the VCO, and FIG. 10 illustrates output frequencies of the VCO.

As shown in FIG. 9, the output frequency Fout of the VCO according to the exemplary embodiments of the present invention is varied to a first frequency F[1] to Nth frequency F[n] according to the inputted power source voltage and a change in the resistance value Rs. Namely, the VCO can vary the frequency by the N number of control signals CS1~CSn supplied from the memory unit 130 as shown in FIGS. 6 to 8. That is, the frequency outputted from the VCO can be variably changed to be within a range from the first frequency F[1] to the Nth frequency F[n] as shown in FIG. 10 by combining the N number of control signals CS1~CSn stored in the memory unit 130. Also, when the frequency to be outputted from the VCO should be a third frequency but it is a second frequency, a frequency correction may be performed to output a desired frequency by combining the N number of control signals CS1~CSn stored in the memory unit 130.

As described above, because the display device includes the timing driver including the VCO configured to perform correction when a frequency higher or lower than a designed frequency, among a variety of generated frequencies, is outputted, so it does not need to be re-designed or re-processed for a frequency adjustment. In addition, because the timing driver does not need to be re-designed or re-processed in order to output a desired frequency, time for designing and a processing unit cost can be reduced. Also, because various frequencies can be generated by using the internal memory unit, an input stage for a frequency correction can be omitted in the timing driver, and thus, the size of the timing driver can be reduced.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel;

a data driver that supplies a data signal to the display panel;

a gate driver that supplies a gate signal to the display panel; and a timing driver including:

a memory unit, a voltage controlled oscillator directly connected to the memory unit via first to N control lines, wherein a frequency output by the voltage controlled oscillator is set based on a total number of control signals output on the N control lines and not based on a single control line, a controller that generates a driving signal by using the frequency supplied from the voltage controlled oscillator so as to control the data driver and the gate driver, and a frequency converter that controls the voltage controlled oscillator by using the control signals output from the memory unit included in the timing driver, wherein the frequency converter comprises:

a decoder unit that converts N number of control signals output from the memory unit into 2N number of control signals; and a combining unit that combines the 2N number of control signals output from the decoder unit, and supplies the 2N number of control signals output from the decoder unit to the voltage controlled oscillator.

2. The device of claim 1, wherein the frequency converter varies an output frequency of the voltage controlled oscillator according to a resistance value varied according to the combination of the control signals.

3. The device of claim 1, wherein the combining unit comprises:

2N number of switch units that perform a switching operation in response to the 2N number of control signals output from the decoder unit; and a resistor unit of which a resistance value is varied according to the switching operations of the 2N number of switch units.

4. The device of claim 3, wherein the resistor unit comprises first to 2Nth resistors configured in series, and the 2N number of switch units are connected in parallel to the first to 2Nth resistors and perform a switching operation in response to the 2N number of control signals output from the decoder unit.

5. The device of claim 4, wherein one end of the first resistor and one end of the 2Nth resistor of the resistor unit are connected to the voltage controlled oscillator.

6. The device of claim 4, wherein, in the resistor unit, one end of the first resistor is connected to a first power line, one end of the 2Nth resistor is connected to a second power line, and at least one node between adjacent resistors included in the first to 2Nth resistors is connected to the voltage controlled oscillator.

7. The device of claim 1, wherein the frequency converter is included in the voltage controlled oscillator.

* * * * *